United States Patent [19]

Shimizu

[11] 3,942,508

[45] Mar. 9, 1976

[54] WIRE-SAW

[75] Inventor: Hiroshi Shimizu, Tokyo, Japan

[73] Assignee: Yasunaga Engineering Kabushiki Kaisha, Tokyo, Japan

[22] Filed: Dec. 18, 1974

[21] Appl. No.: 534,038

[30] Foreign Application Priority Data

Dec. 29, 1973 Japan ..... 49-137
Mar. 30, 1974 Japan ..... 49-36130

[52] U.S. Cl. ..... 125/16 R; 125/21
[51] Int. Cl.[2] ..... B28D 1/06
[58] Field of Search ..... 125/12, 16, 21

[56] References Cited

UNITED STATES PATENTS 3,155,087 11/1964 Dreyfus ..... 125/21
3,841,297 10/1974 Mech ..... 125/12

*Primary Examiner*—Harold D. Whitehead
*Attorney, Agent, or Firm*—Frank J. Jordan

[57] ABSTRACT

A wire saw having a single wire extending from a feeding roller to a take-up roller through a seesaw means and an array-forming and controlling means, so as to form a wire array at an intermediate portion, which wire array is reciprocated for sawing a work piece urged against the wire array. There are provided a means for gradually transferring the fresh wire from the feeding roller to the take-up roller.

6 Claims, 2 Drawing Figures

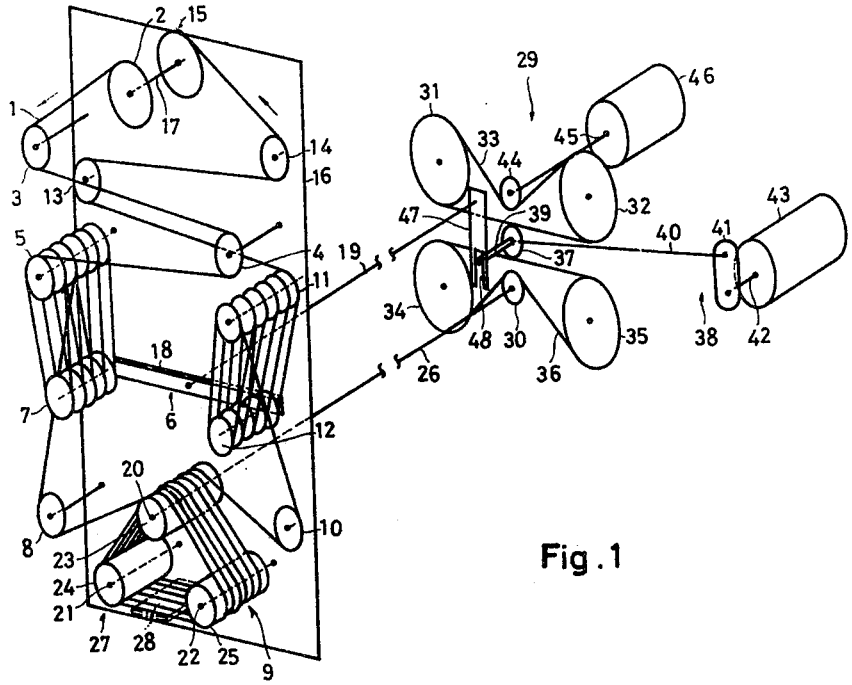
Fig. 1
Fig. 2
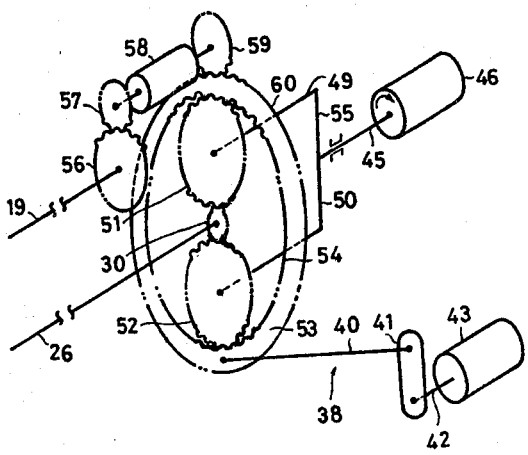

WIRE-SAW

BACKGROUND OF THE INVENTION

1. Field of the Invention

This invention relates to a wire saw, and more particularly to a wire saw having a reciprocating wire array made by looping a single wire, so as to cut a work piece urged against the wire array.

2. Description of the Prior Art

A wire saw using a single extended wire to be longitudinally reciprocatingly moved is known. For instance, U.S. Pat. No. 3,155,087, which was granted to Bertrand A. Dreyfus on Nov. 3, 1964, discloses a machine for sawing samples of brittle materials, which machine comprises a wire extending from a feeding roller to a receiver roller while being turned a number of times around wire guides so as to form a material-cutting wire array, a driving means for positively rotating one of said wire guides in forward and reverse directions for reciprocating the wire in said wire array, and a toggle arrangement for preventing the wire from slackening during the reciprocation. The feeding roller of this machine is connected to a control motor for continuously paying a selected amount of fresh wire, while the receiver roller is mounted to a constant torque motor which drives the receiver roller under the control of a control means, so as to receive the payed amount of the wire while causing a constant tension therein and absorbing the elongation of the wire. Thus, such an arrangement provides a continuous renewal of the wire in the array.

The wire saw of the Dreyfus Patent has a drawback in that its control means of the constant torque type should be adjusted very accurately with extra care, because if the receiver roller rotates too quickly, the wire may be cut off by excessive tension. On the other hand, if the receiver roller rotates too slowly, the wire may be slackened. The slackening may also cause the wire to inaccurately cut the work piece.

The wire saw of the Dreyfus Patent also uses a constant torque reversible motor with an armature directly connected to the driving wire guides, as a means for reciprocating the wire in the wire array. The direction of rotation of the reversible motor is controlled by a limit switch to be actuated by the foresaid toggle arrangement. The constant torque reversible motor is rather expensive, and the limit switch controlling such motor requires frequent replacements because of its comparatively short service life. According to the experience of the inventor of the present application, slipping is caused at the joint between the output shaft of the constant torque reversible motor and the driving wire guide or at a point between the driving wire guide and the wire array, although the reason for such slipping has not yet been found.

Therefore, the object of the present invention is to mitigate the aforesaid difficulties of the conventional wire saw.

SUMMARY OF THE INVENTION

In order to fulfil the aforesaid object, the present invention provides a wire saw having a sawing wire array, comprising a feeding roller which feeds a single wire while causing a tension in the wire; a take-up roller receiving the single wire at a speed faster than the wire-paying speed of the feeding roller, said take-up roller ceasing to receive the wire as the wire tension exceeds a certain magnitude; a plurality of guide rollers around which said wire is turned a number of times so as to form said sawing wire array; a seesaw means with a seesaw lever, one end of the seesaw means expanding and shrinking as said lever swings while causing the opposite end thereof to shrink and expand, said wire from the feeding roller being passed around one end of the seesaw means before engaging said guide rollers, said wire from the guide rollers being turned around the opposite side end of the seesaw means before reaching said take-up roller; a driving means reciprocatingly rotating one of said guide rollers so as to cause the wire in said wire array to reciprocate; an offset means controllably offsetting wire-feeding displacement of said reciprocating rotation of the driving from reverse displacement thereof; and a swinging means causing said seesaw lever to swing in synchronism with said reciprocation of the guide roller so as to prevent the wire from slackening.

In a preferred embodiment of the invention, the driving means of the aforesaid wire saw consists of a driving shaft having one end thereof coaxially connected to said guide roller driven thereby, a pinion coaxially secured to the opposite end of the driving shaft, an upper endless loop means rotatably carried by a pair of sprocket wheels, a lower endless loop means rotatably carried by another pair of sprocket wheels, said lower endless loop means drivingly engaging said pinion of the driving shaft, a reciprocating sprocket operatively engaging both the upper and lower endless loop means, and a crank means causing reciprocation of the reciprocation sprocket, said offset means consisting of a feeding motor selectively rotating said upper endless loop means, the swinging means consisting of a seesaw shaft having one end thereof secured to a central portion of said seesaw lever at right angle thereto, a swing lever having one end thereof secured to the opposite end of the seesaw shaft and the opposite end thereof notched, and a reciprocating shaft having one end thereof connected to said reciprocating sprocket and the opposite end thereof operatively engaged with the notched portion of said swing lever. In the last mentioned embodiment, it is preferable that the upper and lower endless loop means are endless chains, respectively, that the crank means consists of a connecting rod having a shaft secured at one end thereof for journalling said reciprocating sprocket, a crank arm having one end thereof pivotally connected to the opposite end of said connecting rod, and a driving motor with an output shaft connected to the opposite end of the crank arm. The pinion of the above embodiment, which is secured to the driving shaft and engages the lower endless chain, may have a diameter smaller than the diameters of the sprocket wheels carrying the lower endless loop means.

In another embodiment of the present invention, the driving means of the guide roller consists of a driving shaft having one end thereof coaxially connected to the guide roller driven thereby, a pinion coaxially secured to the opposite end of the driving shaft, a crown having an internal gear and an external gear integrally formed thereon, a planet gear means engaging both the pinion of the driving shaft and the internal gear of the crown, and a crank means reciprocatingly turning the crown; the offset means consists of a feeding motor which selectively causes the planet gear means to revolve about the pinion of the driving shaft; and the swinging means consists of a seesaw shaft having one end thereof secured to central portion of said seesaw lever at right angle thereto, a swing gear coaxially secured to the opposite end of the seesaw shaft, and a gear train operatively connecting the swing gear to the external gear of the crown. In the last mentioned embodiment, it is preferable that the crank means consists of a connecting rod having one end thereof pivotally connected to said crown, a crank arm having one end thereof pivotally connected to the opposite end of said connecting rod, and a driving motor with an output shaft connected to the opposite end of the crank arm; said planet gear means consists of a pair of planet gears disposed at diametrically opposite sides of the pinion of the driving shaft; and that said offset means consists of a U-shaped carrier journalling the planet gears and a feeding motor having an output shaft operatively connected to said U-shaped carrier.

An outstanding feature of the wire saw according to the present invention is that fresh wire is fed to the sawing wire array at a controlled uniform rate through the reciprocation of the wire guide rollers actuated by the driving means, which driving means causes different forward and reverse strokes in the guide roller reciprocation under the control of the feeding motor. Another feature of the present invention is that the swinging of the seesaw means is mechanically synchronized with the reciprocation of the wire in the wire array, so that risk of wire slipping on the surface of the guide rollers is eliminated, and the wire is prevented from slackening and excessive tension. Thus, the durability of the wire in the wire saw is considerably improved.

BRIEF DESCRIPTION OF THE DRAWING

These and other features of the present invention will become apparent from consideration of the following specification when taken in conjunction with the accompanying drawing, in which:

FIG. 1 is a schematic perspective view showing a wire saw according to the present invention; and FIG. 2 is a schematic perspective view of a different driving means combined with an offset means for use in the wire saw according to the present invention.

Like parts are designated by like numerals through the different figures of the drawing.

DESCRIPTION OF THE PREFERRED EMBODIMENTS

Referring to FIG. 1, a wire 1 is payed out from a feeding roller 2, which wire is made of a material suitable for sawing work pieces, such as metal, extra-hard metal, or plastic material. The wire 1 is guided by idler rollers 3 and 4, and it is then turned one or more times around two rollers, i.e., a roller 5 journalled by a shaft fixed on a framework 16 and a seesaw roller 7 rotatably carried by one end of a seesaw lever 18. The rollers 5 and 7 form one end portion of a seesaw means 6. Another idler roller 8 guides the wire 1 from the seesaw means 6 to an array-forming and controlling arrangement 9. After passing through the array-forming and controlling arrangement 9, the wire 1 turns around another idler roller 10, so as to be guided to the opposite end portion of the seesaw means 6, wherein the wire is turned one or more times around two rollers, i.e., a guide roller 11 journalled by a shaft secured to the framework 16 and a seesaw roller 12 rotatably connected to the opposite end of the seesaw lever 18. Two idler rollers 13 and 14 direct the wire 1 from the aforesaid opposite end of the seesaw means to a take-up roller 15.

The aforesaid rollers, the seesaw means 6, and the array-forming and controlling arrangement 9 are all disposed on one side surface of the frame work 16, as shown in FIG. 1. In the illustrated embodiment, the feeding roller 2 and the take-up roller 15 are mounted on a common shaft carried by the framework 16, although such arrangement is not restrictive to the present invention. The feeding roller 2 pays out the wire 1 while causing a tension on the wire, for instance, by a suitable brake means (not shown). The take-up roller 15 is adapted to receive the wire 1 at a speed faster than the wire paying speed of the feeding roller 2, and the roller 15 ceases to receive the wire 1 when the tension of the wire exceeds a certain predetermined value. The arrangement for causing the aforesaid functions of the feeding roller 2 and the take-up roller 15 is known.

The central portion of the seesaw lever 18 is fixed to a seesaw shaft 19 extending through the framework 16 to the opposite side thereof, as shown in FIG. 1.

In the preferred embodiment, the array-forming and controlling arrangement 9 includes three multiple-grooved wire guides 23, 24, and 25, which are carried by shafts 20, 21, and 22, respectively. The shafts 21 and 22 are secured to the framework 16 so as to rotatably hold the corresponding wire guides 24 and 25, respectively. The wire guide 23 is coaxially fixed to the shaft 20 which is linearly extended from a driving shaft 26 extending through the framework 16. Thus, the wire guide 23 rotates together with the driving shaft 26, but the former cannot rotate relative to the latter. A wire array 27 is formed by turning the wire 1 around the three grooved wire guides 23, 24, and 25 a number of times, as shown in FIG. 1. As will be described hereinafter, the wire 1 in the wire array 27 is reciprocated, so that a work piece 28 is sawn by the reciprocating wire array when the work piece 28 is urged against the wire array 27 by a suitable elevating means (not shown).

A driving means 29 for the wire 1 will now be described. The driving means 29, as illustrated in FIG. 1, comprises a pinion 30 secured to the opposite end of the driving shaft 26 to the wire guide 23, an upper endless loop means, e.g., a looped chain 33, carried by a pair of spaced sprocket wheels 31, 32, and a lower endless loop means, e.g., a looped chain 36, which is carried by another pair of sprocket wheels 34, 35 and engages the pinion 30 of the driving shaft 26. The sprocket wheels 31, 32, 34, and 35 are disposed in such a manner that they allow the endless chains 33 and 36 to revolve along loci including two parallel linear portions, as shown in FIG. 1. The driving means 29 further includes a reciprocating sprocket 37 which simultaneously engages the parallel linear portions of the chains 33 and 36, and a crank means 38 causing the pinion 37 to reciprocate.

It should be noted here that the pinion 30 at the opposite end of the driving shaft 26 to the wire guide 23 can be dispensed with by directly connecting the driving shaft 26 to either the sprocket wheel 34 or the sprocket wheel 35. Thus, the pinion 30 is not essential to the present invention.

The crank means of the preferred embodiment includes a connecting rod 40 having a shaft 39 secured to one end thereof for journalling the reciprocating sprocket 37 and the opposite end thereof pivotally connected to a crank arm 41, which crank arm 41 has its opposite end fixed to the output shaft 42 of a driving motor 43. Thus, as the driving motor output shaft 42 rotates, the crank arm 41 is turned for reciprocating the sprocket 37. The driving motor 43 is rated, for instance, at 200 Watts and 50 to 70 revolutions per minute (rpm).

When it is desired to gradually feed fresh wire 1 to the wire array 27, the feeding displacement of the reciprocation of the wire 1 in the array 27 should be larger than the reverse displacement of the reciprocation. To this end, an offset means is provided in the wire saw according to the present invention, which causes the pinion 30 of the driving shaft 26 to turn more in the wire-feeding direction than in the reverse direction, for causing similar turning of the wire guide 23. The offset means includes a pinion 44 engaging the upper endless chain 33, and a feeding motor 46 having an output shaft 45 to which the pinion 44 is coaxially secured. The output power of the feeding motor 46 can be comparatively small, for instance, 50 Watts, and its revolving speed must be controllable by a suitable control means (not shown) with or without steps, for instance over a range of 0 to 1 rpm. A reduction gear (not shown) may be used between the motor output shaft 45 and the pinion 44.

As an essential feature of the present invention, the seesaw lever 18 is swung in synchronism with the reciprocation of the wire 1 and with the reciprocation of the pinion 30 of the driving shaft 26. To this end, a swinging means is included in the wire saw, which comprises the seesaw shaft 19 extending from the central portion of the seesaw lever 18, a swing lever 47 having one end thereof secured to the extended end of the seesaw shaft 19 and a notched portion 48 formed at the opposite end thereof, and the shaft 39 interconnecting the reciprocating sprocket 37 and the notched portion 48 of the swing lever 47.

The operation of the wire saw having the aforesaid construction according to the present invention will now be described. At first, it is assumed that the upper endless chain 33 is kept stationary. Under such condition, when the driving motor 43 is started, the sprocket 37 is reciprocated by the crank means 38. Since the upper chain 33 is assumed to be stationary, the sprocket 37 is forced to rotate as it reciprocates along the chain 33. Such rotation of the sprocket 37 causes the lower chain 36 to travel back and forth along the sprocket wheels 34 and 35, so as to reciprocatingly turn the pinion 30 of the driving shaft 26. As a result, the wire guide 23 rotates clockwise and counter-clockwise, for causing the wire 1 of the wire array 27 to reciprocate. As long as the upper chain 33 is at rest, the wire-feeding stroke of the wire reciprocation in the array 27 is the same as the reverse stroke of the reciprocation. The distribution of the linear speeds of the sprocket 37 during the reciprocation is sinusoidal, and the highest linear speed is achieved at the center of the reciprocating stroke. The reciprocation of the sprocket 37 is transmitted to the seesaw shaft 19 through the shaft 39 and the swing lever 47, so as to cause the seesaw lever 18 to swing in synchronism with the reciprocation of the wire guide 23.

With the chain 33 kept still, if the sprocket 37 is forced to the right, as seen in FIG. 1, the sprocket 37 rotates about the shaft 39 in a counter-clockwise direction, for causing the lower endless chain 36 to turn in a clockwise direction, which results in a counter-clockwise turning of the pinion 30. Thus, the wire guide 23 is turned in a counter-clockwise direction by the pinion 30 through the driving shaft 26. At this time, the seesaw lever 18 is apparently turned in a counter-clockwise direction, too. Thus, the left-hand side seesaw roller 7 moves away from the guide roller 5, while the right-hand side seesaw roller 12 moves toward the guide roller 11. On the other hand, the counter-clockwise rotation of the wire guide 23 causes the wire 1 in the wire array 27 to move to the right. Thus, the wire 1 is payed out from the array-forming and controlling arrangement 9 toward the guide roller 8, and the increased distance between the rollers 5 and 7 due to the counter-clockwise swing of the seesaw lever 18 absorbs the length of the wire 1 thus payed out from the arrangement 9. The corresponding length of the wire 1 is payed out from the righthand side of the seesaw means 6 to the array-forming and controlling arrangement 9, thanks to the reduced distance between the rollers 11 and 12. Accordingly, the wire 1 is prevented from slackening and excessive stretching at the time of its rightward movement in the wire array 27.

It is apparent to those skilled in the art that, with the chain 33 kept still, the movement of the sprocket 37 to the left causes reverse movement of the aforesaid elements of the wire saw, and the angular displacement of the clockwise rotation of the wire guide 23 through the reverse movement is identical to that through the last mentioned counter-clockwise rotation of the wire guide 23. Accordingly, when the chain 33 is kept stationary, the wire 1 is not transferred from the feeding roller 2 to the take-up roller 15.

Now, let it be assumed that the feeding motor 46 is actuated so as to rotate the upper endless chain 33 in a counter-clockwise direction. If the stroke of the reciprocation of the sprocket 37, i.e., the distance from the extreme left position of the sprocket 37 to its extreme right position during the reciprocation caused by the crank means 38, is represented by L, and if the upper endless chain 33 is rotated in a counter-clockwise direction at such a speed that the chain 33 travels over a distance of $d$ when the sprocket 37 travels the full stroke L, then, as the sprocket 37 completes one reciprocating cycle, the lower endless chain 36 is fed in a wire-feeding, or clockwise, direction by a distance of $L+d$ and in the reverse, or counter-clockwise, direction by a distance of $L-d$, i.e., a net distance of $2d$ in the wire-feeding direction. Thus, for one reciprocation cycle of the sprocket 37, the wire guide 23 is turned more in the clockwise direction than in the counter-clockwise direction, with a differential amount corresponding to the net distance $2d$ of the lower endless chain 36. As a result, the wire 1 is fed toward the take-up roller 15.

Accordingly, the clockwise rotation of the upper endless chain 33 causes the feeding of the wire 1 toward the take-up roller 15. It is apparent to those skilled in the art that wire feeding speed into the take-up roller 15 can be controlled at will, by regulating the revolving speed of the feeding motor 46. It is also possible to check the wire wearing speed in the wire saw, by gradually feeding fresh wire 1 through the wire saw while sawing work pieces, and if the wire 1 is found to be available for reuse, the sawing operation may be effected by feeding the wire 1 in the reverse direction. In this case, certain modification must be made on the rollers 2 and 15: for instance, the means applying tension to the wire 1 must act on the former take-up roller and the means which causes the cease of the receiving of the wire upon occurrence of excessive wire tension must act on the former feeding roller.

FIG. 2 illustrates another embodiment of a driving means for reciprocating the sawing wire 1 in the wire array 27 of a wire saw. In FIG. 2, single wire 1 is assumed to be arranged in the same manner as in the case of FIG. 1, and a pinion 30 secured to the opposite end of a driving shaft 26 to a wire guide 23 engages a planet gear means, e.g., a pair of planet gears 51 and 52 which are journalled by shafts 49 and 50, respectively, so as to be disposed symmetrically with respect to the pinion 30. The planet gears 51 and 52 of the illustrated embodiment engage an internal gear 54 formed on the inner peripheral surface of an annular crown 53. The crown 53 is pivotally connected to one end of a connecting rod 40 constituting a part of a crank means 38, which is similar to that of FIG. 1. Accordingly, the crown 53 is reciprocatingly rotated by actuating the crank means 38. When the axes of the planet gears 51 and 52 are held stationary, the reciprocation of the crown 53 is transmitted to the driving shaft 26 through the planet gears 51, 52 and the pinion 30, for linearly reciprocating the wire 1 at the wire array 27 by the wire guide 23 secured to the shaft 20.

An offset means, which causes the aforesaid stroke of the reciprocation of the driving shaft 26 to become different from the reverse stroke thereof, includes a U-shaped carrier having a pair of parellel legs formed of the shafts 49, 50 and a connecting portion 55 extending between the two parallel legs. The connecting portion 55 is connected to the output shaft 45 of a feeding motor 46 at the middle point between the two shafts 49 and 50. The output shaft 45 is disposed in parallel with the shafts 49 and 50.

To swing the seesaw lever 18 in synchronism with the reciprocating rotation of the driving shaft 26, a gear 56 is secured to a seesaw shaft 19 extending from the central portion of the seesaw lever 18, as shown in FIG. 2. The gear 56 meshes a gear 57, which is operatively connected to another gear 59 engaging an external gear 60 formed on the outer peripheral surface of the crown 53. A reduction gear 58 may be used for transmitting the rotation of the gear 59 to the gear 57. Thus, as the crown 53 is reciprocated about the pinion 30 by the crank means 38, the seesaw shaft 19 is turned in synchronism with the driving shaft 26, so as to cause the seesaw lever 18 to swing in synchronism with the reciprocation of the wire 1.

In operation of the driving means 29, as illustrated in FIG. 2, if the feeding motor 46 is at rest for keeping the shafts 49 and 50 of the planet gears 51 and 52 stationary, the rotation of the output shaft 42 of a driving motor 43 causes the crown 53 to reciprocatingly rotate. Whereby, the driving shaft 26 is reciprocatingly rotated by the crown 53 through the planet gears 51, 52 engaging both the internal gear 54 of the crown 53 and the pinion 30 of the shaft 26, and at the same time, the external gear 60 of the crown 53 causes the synchronized reciprocating rotation of the seesaw shaft 19 through the gear train made of the aforesaid gears 59, 58, 57, and 56. Thus, the seesaw lever 18 is swung in synchronism with the sawing reciprocation of the wire 1, as pointed out above. In this case, it is apparent that the wire-feeding stroke of the wire reciprocation is identical with the reverse stroke thereof, so that the wire is not fed to either feeding or reverse direction.

On the other hand, if the feeding motor 46 is started when the driving motor 43 is running, the output shaft 45 of the motor 46 is rotated, for instance, in a clockwise direction, as shown by the arrow of FIG. 2, so as to turn the planet gears 51 and 52 in the similar, e.g., clockwise, direction. As a result, the clockwise angular displacement of the pinion 30 during the counter clockwise stroke of the reciprocating crown 53 will become larger than the counter-clockwise angular displacement of the pinion 30 during the clockwise stroke of the reciprocating crown 53, so that the wire guide 23 connected to the pinion 30 through the driving shaft 26 is turned more in a clockwise direction than in a counterclockwise direction, for feeding the wire 1 toward the take-up roller 15 by a length corresponding to the difference between the aforesaid clockwise and counter-clockwise angular displacements of the pinion 30.

The last mentioned feeding of the wire 1 will be described in further detail by taking a numerical example. If the gear ratio between the internal gear 54 and the pinion 30 is 300:34, the reciprocation of the crown 53 over an angular displacement of $\theta°$ will result in $n$ turns of the shaft 26 in each direction, which $n$ is given by $$n = \frac{300}{24}\left(\frac{\theta°}{360°}\right),$$

provided that the planet gears 51 and 52 are kept still. If the revolving speed of the output shaft 45 of the feeding motor 46 is 0.5 rpm, or 180° per minute, and if the diameter of the wire guide 23 is D meter, the length S of the fresh wire 1 to be fed per minute will be $$S = \frac{300}{24} \times \frac{1}{2} D\pi \text{ meter.}$$

In this case, if the friving shaft 26 makes 60 reciprocating cycles per minute, the length $S_0$ of the wire 1 to be fed by each reciprocating cycle will be $S_0 = S/60$ meter. On the other hand, there are the following relations among the length $S_1$ of the wire 1 to be moved by the rotation of the driving shaft 26 in the feeding direction, the length $S_2$ of the wire 1 to be moved by the rotation of the driving shaft 26 in the reverse direction, and the net length $S_3$ of the wire 1 to be moved by the one reciprocating cycle of the driving shaft 26.

$$S_1 = \frac{300}{24}\left(\frac{\theta°}{360°}\right) D\pi - \frac{S}{60\times 2} \quad S_2 = \frac{300}{24}\left(\frac{\theta°}{360°}\right) D\pi - \frac{S}{60\times 2} \quad S_3 = S_1 - S_2$$

What is claimed is:

1. A wire-saw having a sawing wire array, comprising a feeding roller feeding a single wire;

a take-up roller receiving said single wire;

a plurality of guide rollers around which said wire is turned a number of times so as to form said sawing wire array;

a seesaw means with a seesaw lever having seesaw rollers on either end thereof;

a non-displaceable roller associated with each of said seesaw rollers, said single wire passing from said feed roller to one of said seesaw rollers and associated non-displaceable rollers before continuing on to said sawing wire array, said single wire passing from said sawing wire array to the other of said seesaw rollers and associated non-displaceable roller before passing on to said take-up roller;

a driving means reciprocatingly rotating a driving guide roller means which drives a pinion means alternately clockwise and counterclockwise, so as to cause the wire in said sawing wire array to reciprocate;

a mechanical differential means driven by a motor and incorporated within said driving means so as to provide a difference between the clockwise rotation and the counterclockwise rotation of said pinion means such that application of said motor will control the wire feed; and a swinging means causing said seesaw lever to swing in synchronism with said reciprocation of said driving guide roller means so as to prevent the wire from slackening.

2. A wire-saw according to claim 1, wherein said driving means consists of a driven shaft having one end thereof coaxially connected to one of said guide rollers of said sawing wire array, said pinion means being coaxially secured to the opposite end of said driven shaft, an upper endless loop means rotatably carried by a pair of sprocket wheels, a lower endless loop means rotatably carried by another pair of sprocket wheels, said lower endless loop means drivingly engaging said pinion means on said driven shaft, said reciprocating driving guide roller means operatively engaging both the upper and the lower endless loop means, and a crank means causing reciprocation of said driving guide roller means, said motor of said differential means selectively rotating said upper endless loop means, said swinging means consisting of a seesaw shaft having one end thereof secured to a central portion of said seesaw lever at a right angle thereto, a swing lever having one end thereof secured to the opposite end of said seesaw shaft and having the opposite end thereof notched, and a reciprocating shaft having one end thereof connected to said reciprocating driving guide roller means and the opposite end thereof operatively engaged with said notched portion of said swing lever.

3. A wire-saw according to claim 2, wherein said upper and lower endless loop means each comprise endless chains, and said crank means comprising a connecting rod having a shaft secured at one end thereof for journaling said reciprocating driving guide roller means, a crank arm having one end thereof pivotally connected to the opposite end of said connecting rod, and a driving motor with an output shaft connected to the opposite end of said crank arm.

4. A wire-saw according to claim 2, wherein said lower endless loop means comprises a lower endless chain disposed about sprockets, said driven guide roller means engaging said lower endless chain and having a diameter which is smaller than the diameters of said sprocket wheels carrying said lower endless chain.

5. A wire-saw according to claim 1, wherein said driving means consists of a driven shaft having one end thereof coaxially connected to said guide roller of said sawing wire array, said pinion means being coaxially secured to the opposite end of said driven shaft, a crown having an internal gear and an external gear integrally formed thereon, a planet gear means engaging both the pinion means and the internal gear of said crown, and a crank means reciprocatingly turning said crown, said motor of said differential means selectively causing said planet gear means to revolve about said pinion means, and said swinging means comprises a seesaw shaft having one end thereof secured to a central portion of said seesaw lever at right angle thereto, a swing gear coaxially secured to the opposite end of said seesaw shaft, and a gear train operatively connecting said swing gear to said external gear of said crown.

6. A wire-saw according to claim 5, wherein said crank means comprises a connecting rod having one end thereof pivotally connected to said crown, a crank arm having one end thereof pivotally connected to the opposite end of said connecting rod, and a driving motor with an output shaft connected to the opposite end of said arm, said planet gear means comprising a pair of planet gears disposed at diametrically opposite sides of said pinion means, and said differential means comprises a U-shaped carrier journaling said planet gears, said motor of said differential means having an output shaft operatively connected to said U-shaped carrier.

* * * * *